US005126927A

United States Patent [19]

Reeves et al.

[11] Patent Number: 5,126,927

[45] Date of Patent: Jun. 30, 1992

[54] FLASHLIGHT HAVING IMPROVED BULB ENCLOSURE

[75] Inventors: W. Clay Reeves, Dallas, Tex.; Donald L. Rohrs, Overland Park, Kans.

[73] Assignee: The Brinkmann Corporation, Dallas, Tex.

[21] Appl. No.: 734,042

[22] Filed: Jul. 22, 1991

Related U.S. Application Data

[63] Continuation of Ser. No. 644,693, Jan. 22, 1991, abandoned, which is a continuation of Ser. No. 568,540, Aug. 15, 1990, abandoned, which is a continuation of Ser. No. 434,530, Nov. 7, 1989, abandoned, which is a continuation of Ser. No. 332,402, Mar. 28, 1989, abandoned, which is a continuation of Ser. No. 176,091, Mar. 31, 1988, abandoned.

[51] Int. Cl.[5] ..... F21L 15/02; F21L 7/00

[52] U.S. Cl. ..... 362/187; 362/205

[58] Field of Search ..... 362/187, 188, 202, 203, 362/205, 208

[56] References Cited

U.S. PATENT DOCUMENTS

| | | | |
|---|---|---|---|
| 1,584,539 | 5/1926 | Hopkins | 362/188 |
| 1,680,169 | 8/1928 | Osean | 362/188 |
| 1,703,749 | 2/1929 | Rahm | 362/188 |
| 2,016,819 | 10/1935 | Meginniss | 362/188 |
| 2,097,222 | 10/1937 | Tompkins et al. | 240/10.66 |
| 2,259,106 | 10/1941 | Hager | 200/60 |
| 2,338,078 | 12/1943 | Wood | 362/187 |
| 2,339,356 | 1/1944 | Sachs | 240/10.69 |
| 2,490,830 | 12/1949 | Norton | 240/10.68 |
| 2,599,295 | 6/1952 | Thomas | 362/205 |
| 2,915,621 | 12/1959 | Garland | 362/205 |
| 2,931,005 | 3/1960 | Saurwein | 339/182 |
| 2,945,944 | 7/1960 | Gillespie | 362/188 |
| 3,076,689 | 2/1963 | Taylor | 240/10.66 |
| 4,203,150 | 5/1980 | Shamlian | 362/183 |
| 4,234,913 | 11/1980 | Ramme | 362/158 |
| 4,261,026 | 4/1981 | Bolha | 362/101 |
| 4,286,311 | 8/1981 | Maglica | 362/205 |
| 4,307,439 | 12/1981 | Sassmannshausen | 362/202 |
| 4,329,740 | 5/1982 | Colvin | 362/184 |
| 4,388,673 | 6/1983 | Maglica | 362/188 |
| 4,398,232 | 8/1983 | Elmore | 361/47 |
| 4,429,351 | 1/1984 | Petzl et al. | 362/187 |
| 4,472,766 | 9/1984 | Hung | 362/158 |
| 4,495,551 | 1/1985 | Foltz | 362/205 |
| 4,527,223 | 7/1985 | Maglica | 362/187 |
| 4,531,178 | 7/1985 | Uke | 362/158 |
| 4,577,263 | 3/1986 | Maglica | 362/187 |
| 4,630,456 | 12/1986 | Nielsen, Jr. | 285/80 |
| 4,656,565 | 4/1987 | Maglica | 362/187 |
| 4,658,336 | 4/1987 | Maglica | 362/203 |
| 4,777,582 | 10/1988 | Sharrah | 362/205 |
| 4,942,505 | 7/1990 | Maglica | 362/187 |

FOREIGN PATENT DOCUMENTS

| | | | |
|---|---|---|---|
| 138873 | 10/1950 | Australia . | |
| 2372382 | 11/1976 | France . | |
| 411218 | 6/1934 | United Kingdom . | |
| 2080468 | 2/1982 | United Kingdom | 285/92 |

OTHER PUBLICATIONS

Brochure for "SMALL 'N MIGHTY" from Mag Instrument (undated).

*Primary Examiner*—Richard R. Cole

*Attorney, Agent, or Firm*—Pretty, Schroeder, Brueggemann & Clark

[57] ABSTRACT

A flashlight includes a barrel portion for enclosing and retaining batteries and comprising an end for accepting a movable bulb enclosure. The moveable bulb enclosure engages the end of the barrel so that the bulb enclosure is axially movable along the barrel portion. A bulb holder is provided at the second end for removably holding a bulb such that the bulb is relatively stationary during axial movement of the bulb enclosure. A stop is provided on the end of the barrel portion for preventing complete removal of the movable bulb enclosure from the barrel portion.

13 Claims, 5 Drawing Sheets

FLASHLIGHT HAVING IMPROVED BULB ENCLOSURE

This application is a continuation of application Ser. No. 644,693 filed Jan. 22, 1991 which was a continuation of application Ser. No. 5678,540 filed Aug. 15, 1990 which was a continuation of application Ser. No. 434,530 filed Nov. 7, 1989 which was a continuation of application Ser. No. 332,402, filed Mar. 28, 1989, which was a continuation of application Ser. No. 176,091 filed Mar. 31, 1988 all of which have been abandoned.

BACKGROUND

1. Field of the Invention

The present invention relates to flashlights and more specifically to flashlights having movable heads.

2. Related Art

Flashlights, such as that shown in U.S. Pat. No. 4,577,263, have movable heads to activate internal switch mechanisms or to focus the beam by longitudinal movement of the flashlight head relative to the barrel. In one configuration, when the head of the flashlight is fully threaded on the barrel, the switch mechanism is such that an electrical circuit through the batteries of the flashlight, through contacts between the batteries and the bulb and through the flashlight barrel, the tail cap and back to the batteries is open. As the head is threaded away from the barrel, the electrical circuit is closed, thereby passing current through the bulb to produce a light beam. As the head is further threaded away from the barrel, the head can ultimately be removed from the barrel, leaving the bulb exposed beyond the end of the barrel.

Though removal of the flashlight head provides an ambient light source, the bulb is easily damaged by only a small impact, thereby rendering the flashlight inoperable unless spare bulbs are readily available. To this end, manufacturers have provided a cavity in the tail cap of such flashlights for holding spare bulbs, but it can store only one. Therefore, the ability to use such a flashlight as an ambient light source is of questionable value.

With flashlights of the above-noted type made as pocket-sized flashlights, the barrel, head and tail cap are the main external components. Because these flashlights are to be placed in the pockets of clothing or purses, these portions of the flashlight should be substantially free of projections and sharp edges to minimize the possibility of catching fabric and thereby damaging the fabric. Thus, an internal switch is a desirable feature since external switch mechanisms may catch on a fabric Also, many flashlights which take AA-sized batteries include a tail cap having a hole bored through the end thereof for accepting a key ring or lanyard However, smaller flashlights accepting AAA-sized batteries would require a substantial amount of material in the tail cap to allow such a bored hole for accepting keyrings and lanyards Such additional material would add to the size and weight of the flashlight, which would be undesirable for pocket-sized flashlights.

SUMMARY OF THE INVENTION

A flashlight according to the present invention comprises a barrel portion for enclosing and retaining batteries and comprising an end for accepting a bulb enclosure. A movable bulb enclosure engages the end of the barrel so that the bulb enclosure is axially movable along the barrel portion. Means are provided at the end for removably holding a bulb such that the bulb is stationary relative to the bulb enclosure during axial movement of the barrel portion for preventing complete removal of the movable bulb enclosure from the barrel portion.

In a preferred embodiment, the flashlight includes an end cap which forms part of an electrical circuit for illuminating the bulb. The flashlight also includes an internal switch assembly located at the end of the barrel portion which assembly is actuated by relative axial movement of the bulb enclosure.

In one form of the invention, the bulb enclosure absent its reflector and retaining ring is threaded on the second end of the barrel portion. A ring is then fitted in a groove at the end of the threads on the second end of the barrel portion, between the threads and the extreme second end of the barrel portion. As the bulb enclosure is threaded away from the barrel portion, the threads of the bulb enclosure eventually contact the ring, thereby preventing further disengagement of the bulb enclosure from the barrel. In a further preferred embodiment, the bulb enclosure includes a reflector surrounding a portion of the bulb. The position of the bulb, the dimensions of the reflector and bulb enclosure are such that the base of the reflector encircling the bulb still encircles the bulb when the bulb enclosure comes into contact with the ring at the end of the threads on the barrel. This prevents any possibility of misalignment between the bulb and reflector when direction. However, the portion of the reflector encircling the bulb may include a conical portion which assists in guiding the reflector over the end of the bulb when the reflector is first assembled over the bulb and at other times when the reflector is being put back into the bulb enclosure, for example, after the bulb is changed In a further embodiment of the present invention, the tail cap is formed to include a tip recessed from the outside diameter of the end cap to form a shoulder so that a semi-circular D-ring can be placed on the tip of the end cap. The ring would include ends having projections facing diametrically inward toward the opposite end The projections fit retaining the ring on the end cap. The ring and the tip are formed such as to allow the ring to lie nearly flat against the shoulder or to rotate through an arc of 180° from one side of the end cap to the other. Furthermore, the ring and tip of the end cap are formed so as to allow the ring to stand upright 90° from the flush positions of the ring. When the ring is upright, the ring is substantially stable and will stay in that position substantially without falling to one side or the other. When the ring is at its extreme positions, flush against the shoulder, the outside edge of the ring may extend beyond the outside diameter of the end cap.

DETAILED DESCRIPTION OF THE PREFERRED EMBODIMENTS

Figure 1:
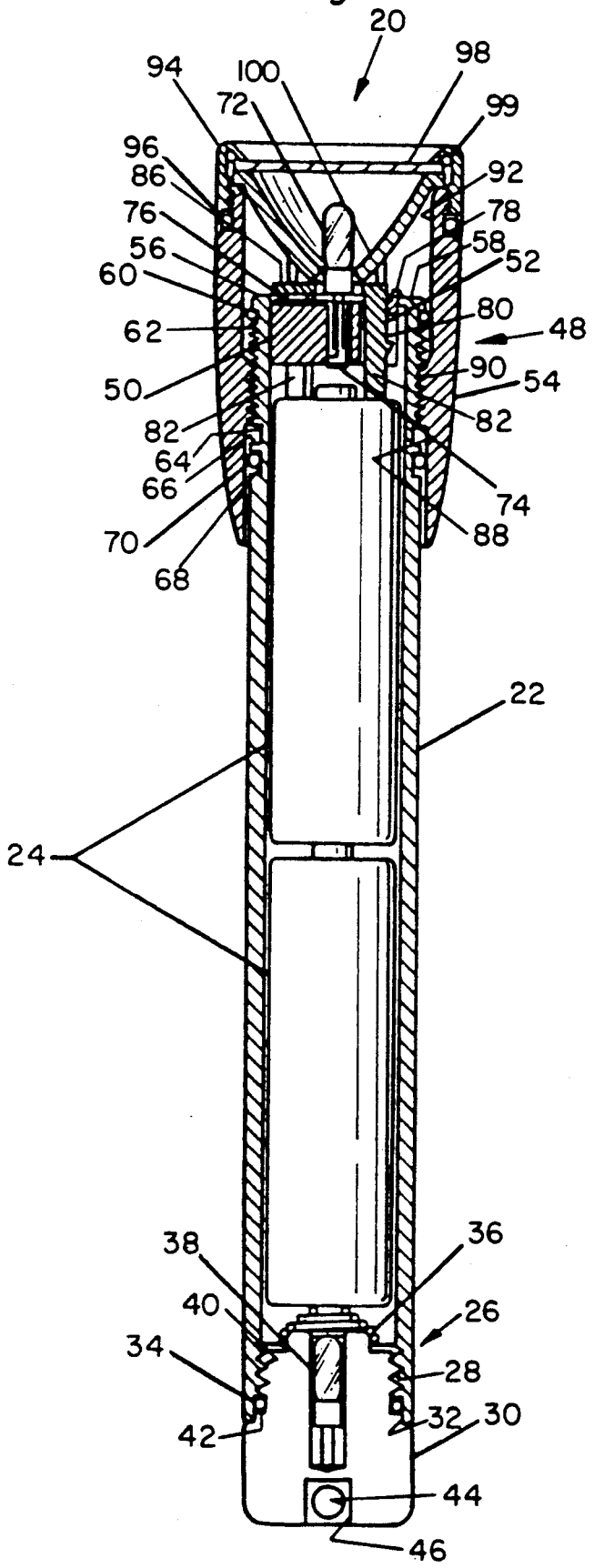
FIG. 1 is a side sectional view of a flashlight according to the present invention in the switched off condition.

A flashlight 20 (FIG. 1) includes a cell-tube or barrel portion 22 for enclosing and retaining one or more battery cells 24 or other power supply and for providing a handle for the flashlight. Preferably, the battery cells are arranged so that the positive electrodes are directed in the direction of the bulb. The barrel portion is preferably formed from a metallic material such as machined aluminum to form part of the electrical circuit for the flashlight and for strength and light weight. A first end 26 of the barrel portion includes internal threads 28 for engaging an end cap 30. The first end includes a counter-bore 32 extending from the lip of the first end to the internal threads for accommodating an O-ring 34 to be seated in the counter-bore.

The end cap 30 is preferably formed from the same material as the barrel portion to conduct electrical current as part of the electrical circuit for providing light. The end cap includes an end cap spring 36 which is a conical compression spring for biasing the batteries 24 toward the bulb holder and contacts (described more fully below) and for providing part of the electrical circuit The broad base of the compression spring fits over a hollow boss on the internal end of the end cap. The boss is hollow to accept a spare bulb 38. The O-ring 34 encircles a portion of the end cap on the opposite side of threads 40 from the end cap spring 36. The O-ring fits in a groove and rests against a shoulder 42 whose outside diameter is slightly smaller than the inside diameter of the counter-bore 32. Beyond the shoulder, the end cap is enlarged to its outside diameter which is substantially equivalent to the outside diameter of the barrel portion. This provides continuity to the outer surface of the flashlight and minimizes the possibility of catching the flashlight on the fabric of a pocket or purse.

An opening 44 is bored transversely of the end cap to form an opening for a lanyard or key-ring. A pair of radially-extending grooves, one of which is shown as 46 in FIG. 1, extend inward to the opening 44. The opening is preferably in the center of the end cap.

The barrel portion includes a second end 48 opposite the first end 26 for accepting a bulb socket or bulb holder 50 and an internal switch plunger 52 (described more fully below) and for accepting a rotatable and axially movable bulb enclosure 54. The extreme end 56 of the second end 48 includes an inwardly extending rim 58 for providing a contact surface for one of the contacts in the bulb holder (described more fully below). It also provides the surfaces around which the bulb holder locks.

Longitudinally spaced from the extreme end 56 of the barrel portion, a retaining ring 60 rests in a circumferential groove formed in the outside of the barrel portion. The retaining ring prevents complete removal of the movable bulb enclosure (described more fully below) from the barrel portion. The retaining resilient material such as spring steel. Threads 62 are formed in the circumferential surface of the second end 48 of the barrel portion immediately below the groove in which the retaining ring rests. The threads terminate at a thread relief groove 64 extending circumferentially around the barrel portion.

A circumferential ridge 66 forms the lower-most wall for the groove 64 and the upper-most wall for a second groove 68 extending circumferentially around the barrel portion for accepting a resilient O-ring 70. The O-rings 34 and 70 provide moisture seals for the flashlight. O-ring 70 also provides rotational friction to help maintain the rotational position of the bulb enclosure and to stabilize the bulb enclosure. The remainder of the barrel portion is substantially cylindrical from the groove 68 to the first end 26 of the barrel portion.

There are various types of bulb holders known in the art. In the embodiment shown in FIG. 1, the bulb holder 50 is an insulated holder, preferably plastic, and has a pair of openings in the top thereof for removably accepting corresponding pins of a bi-pin bulb 72. The openings or slots are electrically isolated from each other to prevent shorting out of the electrical circuit At least one of the openings extends the length of the bulb holder and accepts a metal contact 74 extending substantially the longitudinal length of the bulb holder and further including a tab extending transversely over the opening of part of the lower portion of the bulb holder for contacting the positive electrode of the battery adjacent the bulb holder. The contact 74 forms part of the electrical circuit between the battery at the second end of the barrel portion and the barrel. The contact 74 electrically contacts one electrode of the bi-pin bulb 72.

A second contact 76 extends at least part way into the second opening in the bulb holder for bulb. The second contact includes a leaf portion extending transversely across part of the bulb holder at an upper portion thereof for contacting the lower surface of the inwardly extending rim 58 on the barrel. The second contact serves to complete the electrical circuit between the batteries in the barrel and the barrel through the bulb. The bulb holder extends substantially outward to the inside diameter of the barrel. The bulb holder preferably includes flexible leaf portions 78, one of which is shown in FIG. 1. The flexible leaf portions include edges which extend over the top of the inwardly extending rim 58 to lock the bulb holder onto the interior and exterior portions of the rim. The leaf portions are flexible so that the bulb holder, upon installation, can be passed upwardly through the inside of the barrel from the first end toward the second end. As the bulb holder reaches the rim 58, the flexible leaf portions can be moved inwardly so that they pass through the internal diameter formed by the rim 58 and snapped over the rim to hold the bulb holder in place.

In the preferred embodiment, the bulb holder includes three equally spaced, peripheral holes in the leaf portions 78 above longitudinally extending grooves 80 extending along the outer surface of the bulb holder for accommodating legs 82 of the switch plunger 52. The switch plunger 52 preferably includes three equally spaced longitudinally extending legs 82 having a length greater than the longitudinal dimension of the bulb holder so that the switch plunger can move longitudinally relative to the bulb holder. The legs of the switch plunger are joined at their tops by a ring member 86 preferably having three outwardly extending accurate segments for extending over the rim 58 between corresponding flexible leaf portions 78. The ring member includes an opening for accommodating the base of the bi-pin bulb. The base and pins of the bi-pin bulb pass through the opening in the ring member. Outwardly extending protrusions on each of the legs of the switch plunger prevent the switch plunger from being ejected from the bulb holder under ordinary conditions. When the flashlight is fully assembled with the appropriate number of batteries, the batteries are biased against the legs of the switch plunger by the end cap spring 36 so that the positive electrode of the foremost battery contacts the contact 74 unless there is a greater counter-force against the top 86 of the switch plunger 52 such as, for example, by means of the reflector, described more fully below, to compress the spring 36.

The bulb enclosure 54 includes at its lower end a counter-bore 88 for encircling the upper portion of the barrel and for providing a seal, with the O-ring 70, between the interior of the bulb enclosure 54 and the exterior of the barrel. The counter-bore 88 terminates in internal threads 90 for engaging the corresponding threads 62 on the second end of the barrel. The threads allow the bulb enclosure to be axially moved relative to the barrel to activate the switch plunger for turning the flashlight on and off and to focus the resulting beam as a function of the relative axial location of the bulb and bulb enclosure/reflector.

A second counter-bore 92 is formed in the internal surface of the bulb enclosure on the opposite side of the threads from the counter-bore 88. The second counter-bore 92 terminates at the first, or upper-most as seen in FIG. 1, thread of the bulb enclosure. The first thread contacts the retaining ring 60 when the bulb enclosure is threaded sufficiently away from the barrel portion 22, thereby retaining the bulb enclosure on the end of the barrel and preventing complete removal from the barrel portion.

A top ring 94 is threaded over the outer-most extreme end of the bulb enclosure and includes a counter-bore for providing a seal with the bulb enclosure through an O-ring 96. The top ring retains a lens 98, sealed against an inwardly extending rim of the top ring by an O-ring 99. The top ring also holds the reflector 100 against the upper rim of the bulb enclosure. The outer circumference of the lens and the upper rim of the reflector are held in a space formed between the top ring 94 and the upper rim of the bulb enclosure.

Figure 2:
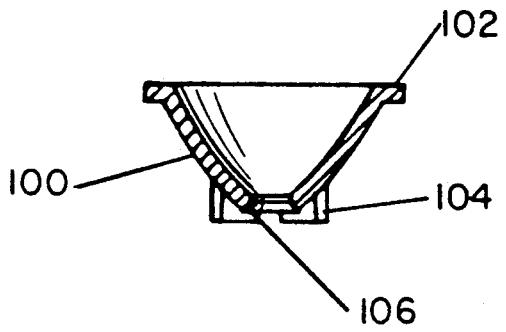
FIG. 2 is a side-sectional view of a reflector of the flashlight of FIG. 1.
Figure 3:
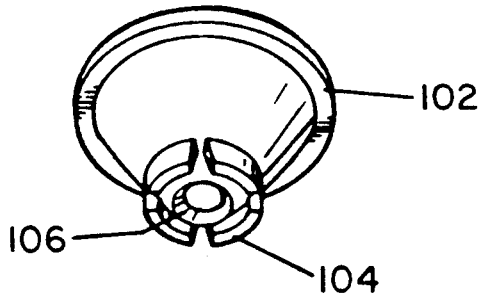
FIG. 3 is a perspective view of the base of the reflector of FIG. 2.

FIG. 2 shows the reflector 100 in more detail. The reflector includes the upper rim 102 extending outwardly and the circumferential wall 104 which contacts the upper surface of the switch plunger 86 (FIG. 1) to actuate the switch plunger upon movement of the bulb enclosure. The wall 104 may be segmented as shown in FIGS. 2 and 3. The reflector further includes a bulb guide 106 in the form of a partial conical section converging from its lower-most extent upwardly in the direction of the rim 102 to the opening in the reflector for accommodating the bulb 72 (FIG. 1). The bulb guide serves to guide the bulb into the reflector when the reflector is placed over the bulb, for example when the bulb has been replaced.

The flashlight of FIG. 1 is assembled by placing the contacts 74 and 76 in the bulb holder, which is then passed from the first end along the interior of the barrel to the second end and locked into position by means of the flexible leaf portions. The legs 82 of the switch plunger 52 are inserted into the holes of the leaf portions 78 of the bulb holder and are pressed inwardly so that they pass through the peripheral holes of the bulb holder. The ring 86 extends over the upper portion of the rim. The O-ring 70 is placed in its groove and the bulb enclosure, absent the top ring 94, lens 98 and reflector 100 is placed over the second end of the barrel and threaded completely on the barrel. The retaining ring 60 is spread over the extreme end of second end 48 and placed in its groove. The retaining ring is allowed to contract in the groove so that it stays in the groove. The bulb 74 is placed in the bulb holder. Then the top ring, lens and reflector are assembled with the bulb enclosure as would be known to one skilled in the art. The batteries and end cap are then installed in the flashlight.

Figure 5:
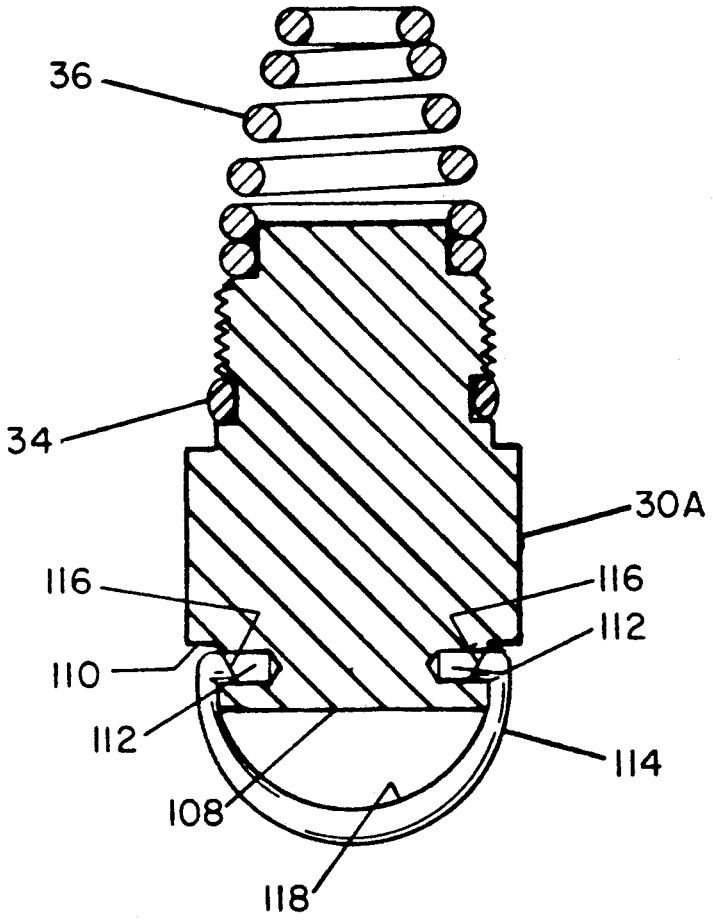
FIG. 5 is a partial cross-sectional view of a further embodiment of the end cap of the flashlight shown in FIG. 1.
Figure 6:
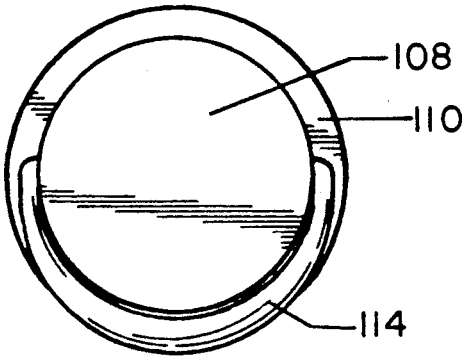
FIG. 6 is an end plan view of the end cap of FIG. 5 showing the D-Ring folded down.

In a further embodiment of the end cap for the flashlight shown in FIG. 1, an end cap 30A (FIG. 5) is substantially circular in transverse cross section and includes a recessed tip 108 having an outside diameter less than the outside diameter of the end cap. The tip joins the rest of the end cap at a shoulder 110 on the end of the end cap. The circumferential surface 108 of the tip includes a pair of diametrically opposed holes 112 formed therein for accepting a spring biased D-ring 114. Each end of the D-ring includes projections 116 extending along a diameter of the D-ring for engaging the diametrically opposed holes in the tip. The D-ring is preferably formed from a resilient material such that the distance between the projections 116 when the D-ring is in its relaxed state is less then the same distance when the D-ring is spread over the tip. The projections are slanted so that the surfaces of the projections converge inwardly toward the remainder of the D-ring in order to facilitate attachment of the D-ring to the end cap. The D-ring may be installed by laying it flat on the shoulder 110 and sliding the D-ring along the shoulder. The slanted surfaces on the projections allow the projections to ride up and over the circumferential surface of the tip and snap into the holes. With the D-ring down against the shoulder, the inside of arc 118 of the D-ring conforms substantially to the outside circumference of the tip of the end cap (FIG. 6). The spring bias of the D-ring allows it to stand upright alone as shown in FIG. 5 when positioned perpendicular to the flat surface of the tip 108. As a result, the D-ring will stay in the upright position without additional support. The D-ring can be moved in either direction from its upright position so that the D-ring will lie nearly flat against the shoulder 110. The outer circumferential dimensions of the D-ring may be such that the D-ring extends slightly outward beyond the outside diameter of the end cap so that the D-ring can be easily lifted from the shoulder to the upright position using a thumb or finger. The D-ring provides an accessible means for attaching a key-ring or lanyard to the flashlight. This is especially helpful for particularly small flashlights, such as those using AAA-size batteries. The D-ring is formed from spring steel by chemical milling or stamping as would be known to one skilled in the art.

Figure 4:
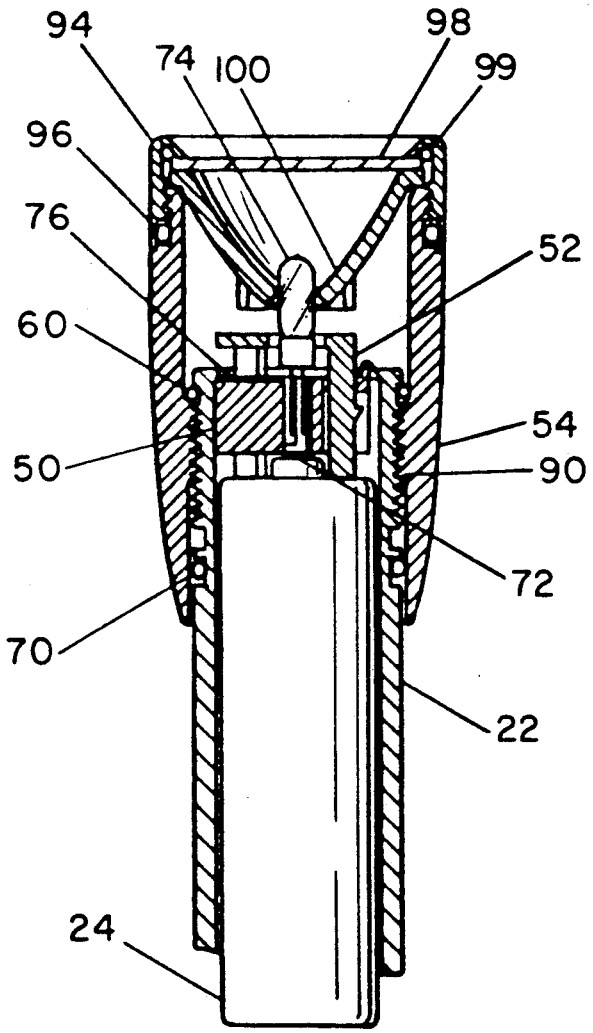
FIG. 4 is a side-section of the head and upper barrel portions of the flashlight shown in FIG. 1 in a switched on condition.

The operation of the flashlight will now be described. It will be assumed that the initial configuration of the flashlight will be as shown in FIG. 1, wherein the flashlight is switched off. The bulb enclosure 54 is threaded onto the second end of the barrel as fully as possible whereby the reflector 100 has pushed the switch plunger 52 completely down and preferably into contact with the inwardly extending rim of the barrel so that the batteries are pushed against the bias of the end cap spring 36 so that a open circuit is created between the batteries and the center contact 74. In order to turn on the flashlight, the enclosure is threaded in the direction away from the barrel, thereby also moving the reflector away from the end of the barrel. This relieves part of the counter force on the switch plunger so that the bias of the end cap spring moves the batteries and the switch plunger upward. As the bulb enclosure is further threaded away from the barrel portion, the positive electrode of the forward-most battery contacts the center contact 74 of the bulb holder. This closes the circuit and illuminates the bulb. FIG. 4 shows the forward-most battery in contact with the center contact 74. Further rotation of the bulb enclosure relative to the barrel advances the reflector further along the bipin bulb to thereby change the focal point for the beam. Further rotation of the bulb enclosure therefore changes the width of the resulting beam. As the bulb enclosure is further threaded away from the barrel portion, the threads on the bulb enclosure come into contact with the retaining ring 60, thereby preventing further removal of the bulb enclosure. This configuration is shown in FIG. 4, representing the furthest extent that the bulb enclosure can be threaded away from the barrel. In this configuration, the seal between the O-ring 70 and the bulb enclosure is still effective. Moreover, the reflector still encircles a portion of the bipin bulb, minimizing the possibility that the reflector could jam against the bulb during ordinary operation. However, when the top ring and reflector are removed, such as to change the bulb, the conical section at the base of the reflector still serves as a guide for the bulb, thereby minimizing the possibility of the reflector being jammed against the bulb when the top ring is rethreaded onto the bulb enclosure. Additionally, even when the top ring and reflector are removed, the bipin bulb is still protected by the bulb enclosure from damage due to accidental impact, etc. The retaining ring 60 prevents complete removal of the bulb enclosure, which removal would expose the bulb to possible damage by impact.

In the position shown in FIG. 1, the bulb enclosure is fully threaded over the end of the barrel so that the reflector bears against the switch plunger which pushes against the upper-most battery 24, electrode of the battery and contact 74. If the bulb enclosure 54 is threadably advanced so that the bulb enclosure moves longitudinally away from the barrel, the retaining ring 60 to prevent further movement of the bulb enclosure away from the barrel.

It should be noted that the above embodiments are preferred, but others are foreseeable. The described embodiments of the invention are only considered to be preferred and illustrative of the inventive concepts; the scope of the invention is not to be restricted to such embodiments. Various and numerous other arrangements may be devised by one skilled in the art without departing from the spirit and scope of the invention.

I claim:

1. A flashlight comprising:

a barrel portion for enclosing and retaining batteries and including an end or accepting a movable bulb enclosure;

a movable bulb enclosure engaging the end of the barrel so that the bulb enclosure is axially movable along the barrel portion;

means at the end of the barrel portion for removably holding a bulb such that the bulb is stationary relative to the barrel portion during axial movement of the bulb enclosure;

internal switch mans at least partly within the end of the barrel for opening and closing a circuit through axial movement with the bulb enclosure such that the bulb is illuminated when the circuit is closed;

a reflector having an upper portion including a rim of engaging the movable bulb enclosure, a lower base portion for contacting the internal switch means such that axial movement of the bulb enclosure in one direction causes the reflector to contact and move the internal switch means, thereby opening the circuit, and axial movement of the bulb enclosure in the opposite direction moves the reflector away from the internal switch means, thereby closing the circuit, and further including an opening wherein the lower base portion of the reflector includes a circumferential wall spaced from the opening in the reflector; and means on the end of the barrel portion for preventing the movable bulb enclosure from being removed from the barrel portion.

2. The flashlight of claim 1 wherein the circumferential wall is divided into at least two segments.

3. The flashlight of claim 1 wherein the circumferential wall is the only portion of the reflector to contact the internal switch means.

4. The flashlight of claim 2 wherein the internal switch means includes a movable switch plugger having legs spaced part from a wall defining an opening for accommodating the bulb and wherein the segments of the circumferential wall extend parallel to hedges of he switch plunger.

5. The flashlight of claim 2 wherein the segments of the cylindrical wall each extend from the reflector approximately the same distance.

6. The flashlight of claim 5 wherein the circumferential wall includes four segments arranged to contact the switch plunger in a circular pattern.

7. The flashlight of claim 6 wherein the means on the end of the barrel portion for preventing complete removal comprises a ring at the end of the barrel portion such that the threads are on a side of the ring opposite the end of the barrel portion.

8. The flashlight of claim 7 wherein the ring is a split ring.

9. The flashlight of claim 1 further comprising a tail cap and a tail cap ring on the tail cap wherein the ring is formed from a resilient material in the shape of a broken D-ring such that the distance between the ends of the D-ring when in a relaxed condition off the tail cap is less than a distance between the ends of the D-ring when installed on that ail cap.

10. A flashlight comprising:

a barrel portion or enclosing and retaining batteries and including a threaded end or accepting a movable bulb enclosure;

a movable bulb enclosure having internal threads for engaging the end of the barrel so that the bulb enclosure is axially movable along the barrel portion through threaded engagement with the threads on the barrel, thereby focusing a beam produced when the flashlight is on, and wherein movement of the bulb enclosure toward the barrel portion is limited by an edge fixed on the barrel adjacent the threads;

means at the nd of the barrel portion for removably holding a bulb such that the bulb is stationary relative to the barrel portion during axial movement of the bulb enclosure;

a ring on the end of the barrel portion for preventing complete removable of the movable bulb enclosure from the barrel portion arranged so that the internal threads of the bulb enclosure contact the ring when the bulb enclosure is threaded sufficiently away from the barrel;

internal switch means within the end of the barrel for opening and closing a circuit through axial movement of the bulb enclosure so that the bulb is illuminated when the circuit si closed; and a reflector having an upper portion including a rim for engaging the bulb enclosure and a lower base portion including an open or encircling and guiding he bulb into the reflector and a circumferential wall spaced from the opening for contacting the internal switch means such that axial movement of the bulb enclosure in one direction causes the reflector to contact and move the internal switch means to open the circuit, and axial movement of the bulb enclosure in the opposite direction moves the reflector away from the internal switch means to close the circuit.

11. The flashlight of claim 10 wherein the barrel portion comprises a barrel of machine aluminum having external threads for accepting the movable bulb enclosure.

12. The flashlight of claim 10 wherein the ring is a split ring.

13. The flashlight of claim 10 wherein the circumferential wall is divided into more than on segment.

* * * * *

UNITED STATES PATENT AND TRADEMARK OFFICE

CERTIFICATE OF CORRECTION

PATENT NO. : 5,126,927

DATED : June 30, 1992

INVENTOR(S) : W Clay Reeves and Donald L. Rohrs

It is certified that error appears in the above-identified patent and that said Letters Patent is hereby corrected as shown below:

Column 1, line 7, "Ser. No. 5678,540" should be "568,540".

Column 1, line 51 after "fabric" a period "." has been omitted.

Column 1, line 54 after "lanyard" a period "." has been omitted.

Column 1, line 58 after "lanyards" a period "." has been omitted.

Column 2, line 3 after "movement""of the bulb enclosure. Means are provided on the end" has been omitted.

Column 2, line 36 after "changed" a period "." has been omitted.

Column 2, line 43 after the first "end" a period "." has been omitted.

Column 2, line 43 after "fit" "into holes bored in opposite sides of the tip for" has been omitted.

Column 3, line 30 after "circuit" a period "." has been omitted.

Column 3, line 64 after "retaining" "ring 60 is preferably a split ring formed from a" has been omitted.

Column 4, line 19 after "circuit" a period "." has been omitted.

Column 4, line 31 after "bulb holder for" "electrically contacting the other pin of the bi-pin" has been omitted.

Column 4, line 63 "accurate" should be "arcuate".

Column 7, line 38 after "battery 24," "thereby preventing contact between the positive" has been omitted.

UNITED STATES PATENT AND TRADEMARK OFFICE

CERTIFICATE OF CORRECTION

PATENT NO. : 5,126,927

DATED : June 30, 1992

INVENTOR(S) : W Clay Reeves and Donald L. Rohrs

It is certified that error appears in the above-identified patent and that said Letters Patent is hereby corrected as shown below:

Column 7, line 42 after "barrel" "the threads in the bulb enclosure make contact with" has been omitted.

Column 7, line 65 "mans" should be "means".

Column 8, line 1 "of" should be "for".

Column 8, line 23 "plugger" should be "plunger".

Column 8, line 24 "part" should be "apart".

Column 8, line 26 "hedges" should be "the legs" and "he" should be --the--.

Column 8, line 47 "that ail" should be "the tail".

Column 8, line 49 "or" should be "for".

Column 8, line 50 "or" should be "for".

Column 8, line 61 "nd" should be "end".

Column 9, line 6 "si" should be "is".

Column 9, line 9 "open or" should be "opening for".

Column 9, line 10 "he" should be "the".

Signed and Sealed this

Twelfth Day of October, 1993

*Attest:*

*Attesting Officer*

Bruce Lehman

BRUCE LEHMAN

*Commissioner of Patents and Trademarks*